US007907870B2

(12) United States Patent
Haseba et al.

(10) Patent No.: US 7,907,870 B2
(45) Date of Patent: Mar. 15, 2011

(54) FIXING APPARATUS AND IMAGE FORMING APPARATUS

(75) Inventors: Shigehiko Haseba, Kanagawa (JP); Kazuyoshi Itoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 349 days.

(21) Appl. No.: 12/202,877

(22) Filed: Sep. 2, 2008

(65) Prior Publication Data

US 2009/0232534 A1 Sep. 17, 2009

(30) Foreign Application Priority Data

Mar. 17, 2008 (JP) ..... 2008-068201

(51) Int. Cl.
*G03G 15/20* (2006.01)

(52) U.S. Cl. ..... 399/122; 399/69; 399/328; 399/329; 219/216

(58) Field of Classification Search ..... 399/69, 399/122, 328–329; 219/216
See application file for complete search history.

(56) References Cited

U.S. PATENT DOCUMENTS

| | | | | |
|---|---|---|---|---|
| 5,752,148 | A | 5/1998 | Yoneda et al. | 399/329 |
| 6,438,335 | B1 * | 8/2002 | Kinouchi et al. | 399/67 |
| 6,725,009 | B1 | 4/2004 | Tatematsu et al. | 399/329 |
| 6,845,226 | B2 * | 1/2005 | Tatematsu et al. | 399/329 |
| 2004/0101334 | A1 | 5/2004 | Tatematsu et al. | 339/329 |
| 2005/0281595 | A1 | 12/2005 | Kachi | |
| 2007/0047991 | A1 * | 3/2007 | Itoh et al. | 399/69 |
| 2007/0110466 | A1 * | 5/2007 | Yamaji | 399/69 |
| 2008/0124147 | A1 * | 5/2008 | Uehara et al. | 399/329 |
| 2008/0226324 | A1 * | 9/2008 | Baba et al. | 399/69 |
| 2009/0175644 | A1 * | 7/2009 | Nanjo et al. | 399/69 |
| 2009/0245902 | A1 * | 10/2009 | Gon et al. | 399/331 |

FOREIGN PATENT DOCUMENTS

| | | | |
|---|---|---|---|
| CN | 1867874 | | 11/2006 |
| JP | 10-154571 | A | 6/1998 |
| JP | 11-135246 | A | 5/1999 |
| JP | 2002-82549 | A | 3/2002 |
| JP | 2003-307966 | A | 10/2003 |
| JP | 2005-70321 | A | 3/2005 |
| JP | 2005-100729 | A | 4/2005 |
| JP | 2005-81464 | A | 7/2005 |
| JP | 2005-181464 | A | 7/2005 |
| JP | 2005-197000 | A | 7/2005 |
| JP | 2005-202202 | A | 7/2005 |
| JP | 2006-047988 | | 2/2006 |
| JP | 2006-267332 | | 5/2006 |
| JP | 2006-330179 | A | 12/2006 |

* cited by examiner

*Primary Examiner* — David M Gray
*Assistant Examiner* — G. M. Hyder
(74) *Attorney, Agent, or Firm* — Morgan, Lewis & Bockius LLP

(57) ABSTRACT

A fixing apparatus includes a magnetic-field generating part that generates a magnetic field, a fixing rotating body having a heat generating layer that generates heat by an electromagnetic induction action of the magnetic field, a pressurizing member that applies pressure to an outer circumferential surface of the fixing rotating body, a heating member that is arranged in contact with an inner side of the fixing rotating body so as be opposed to the magnetic-field generating part, and heats the fixing rotating body, and a temperature sensing part that is located within a region where the fixing rotating body is opposed to the magnetic-field generating part and where the fixing rotating body is in contact with the heating member, and senses a temperature of the fixing rotating body.

16 Claims, 9 Drawing Sheets

FIXING APPARATUS AND IMAGE FORMING APPARATUS

CROSS-REFERENCE TO RELATED APPLICATIONS

This application is based on and claims priority under 35 USC 119 from Japanese Patent Application No. 2008-068201 filed Mar. 17, 2008.

BACKGROUND OF THE PRESENT INVENTION

1. Technical Field

The present invention relates to a fixing apparatus and an image forming apparatus.

2. Related Art

Among fixing apparatuses each provided in an image forming apparatus such as a printer and a copier, there is one by an electromagnetic induction heat-generating method using, as heat sources, a coil that generates a magnetic field by energization and a heat generating body that generates heat by generating eddy current by electromagnetic induction of the magnetic field.

SUMMARY

A fixing apparatus of a first aspect of the present invention includes a magnetic-field generating part that generates a magnetic field, a fixing rotating body having a heat generating layer that generates heat by an electromagnetic induction action of the magnetic field, a pressurizing member that applies pressure to an outer circumferential surface of the fixing rotating body, a heating member that is arranged in contact with an inner side of the fixing rotating body so as to be opposed to the magnetic-field generating part, and heats the fixing rotating body, and a temperature sensing part that is located within a region where the fixing rotating body is opposed to the magnetic-field generating part and where the fixing rotating body is in contact with the heating member and senses a temperature of the fixing rotating body.

"Within the region where the fixing rotating body is in contact with the heating member" means a region smaller than a maximum range in the circumferential direction where the fixing rotating body and the heating member are in contact, and a notched portion may be included in the region.

BRIEF DESCRIPTION OF THE DRAWINGS

Exemplary embodiments of the present invention will be described in detail based on the following figures, wherein.

DESCRIPTION

An example of a first exemplary embodiment of a fixing apparatus and an image forming apparatus of the present invention is described based on the drawings.

Figure 1:
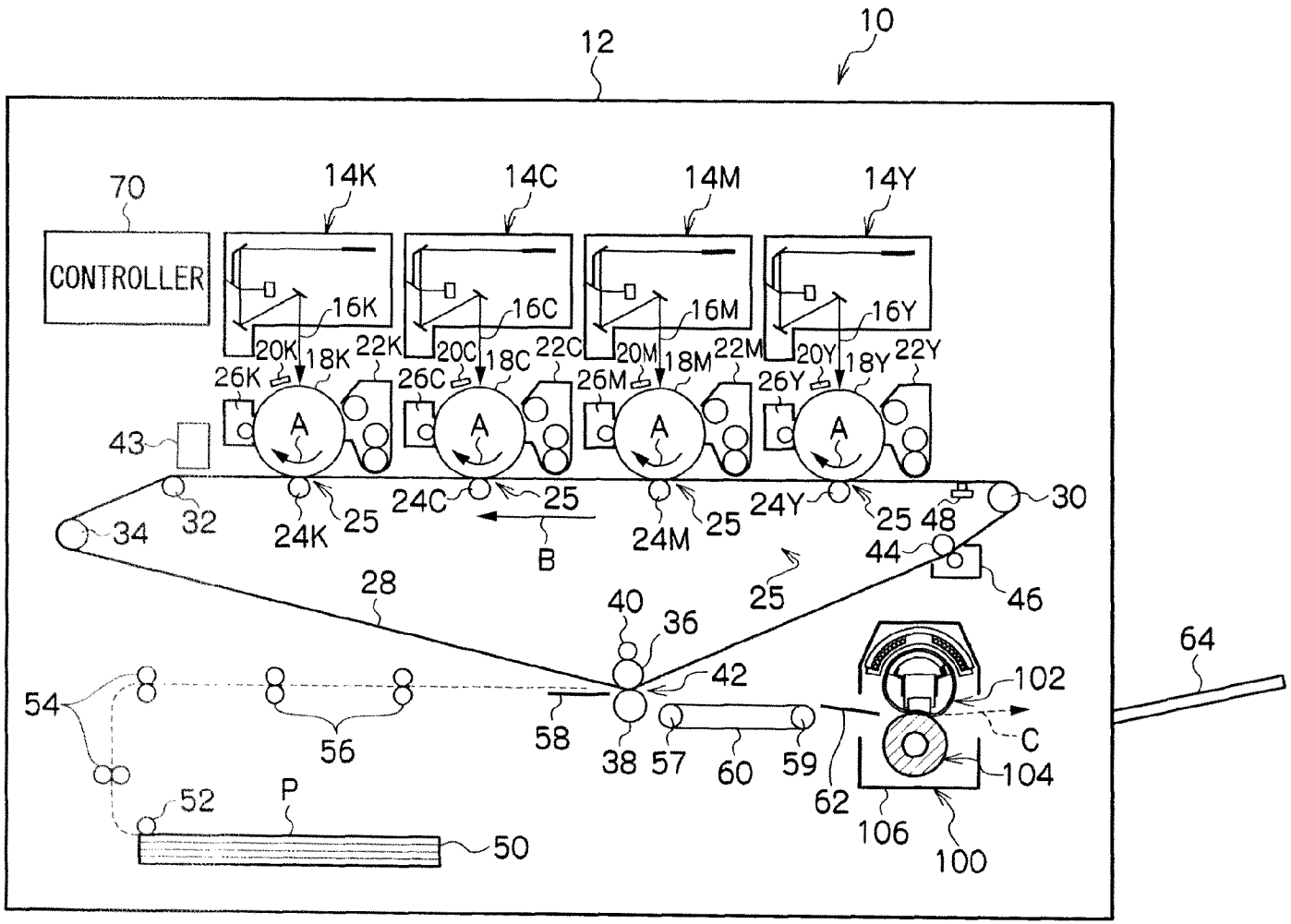
FIG. 1 is an overall diagram of an image forming apparatus according to a first exemplary embodiment of the invention.

FIG. 1 shows a printer 10 as the image forming apparatus. In the printer 10, optical scanning devices 14Y, 14M, 14C and 14K that emit optical beams corresponding to respective toners of yellow (Y), magenta (M), cyan (C), and black (K) are fixed inside of a housing 12 making up a body of the printer 10. In a position adjacent to the optical scanning device 14K, a controller 70 that controls operations of the respective parts of the printer 10 is provided.

The optical scanning devices 14Y, 14M, 14C and 14K scan optical beams emitted from light sources by rotating polygon mirrors (not shown), and the optical beams are reflected by a plurality of optical parts such as reflecting mirrors, so that optical beams 16Y, 16M, 16C and 16K corresponding to the respective toners are emitted.

The optical beams 16Y, 16M, 16C and 16K are guided to respective corresponding photoreceptors 18Y, 18M, 18C and 18K. The photoreceptors 18Y, 18M, 18C and 18K are each rotated in an arrow A direction by drive means made of a motor and a gear (not shown).

Chargers 20Y, 20M, 20C and 20K that charge surfaces of the photoreceptors 18Y, 18M, 18C and 18K are provided on the upstream side in a rotation direction of the photoreceptors 18Y, 18M, 18C and 18K. Also, developing units 22Y, 22M, 22C and 22K that develop the respective toners of Y, M, C and K on the photoreceptors 18Y, 18M, 18C and 18K are provided on the downstream side in the rotation direction of the photoreceptors 18Y, 18M, 18C and 18K.

An intermediate transfer belt 28 to which developed toner images are primarily transferred is arranged on the downstream side of the developing units 22Y, 22M, 22C and 22K in the rotation direction of the photoreceptors 18Y, 18M, 18C and 18K. The intermediate transfer belt 28 is made of a film-like endless belt in which an antistatic agent such as carbon black is contained in a proper amount in a resin such as polyimide and polyamide.

Inside of the intermediate transfer belt 28 and in positions where the photoreceptors 18Y, 18M, 18C and 18K and the intermediate transfer belt 28 are opposed, the primary transfer rolls 24Y, 24M, 24C and 24K that transfer the respective color toner images formed on the photoreceptors 18Y, 18M, 18C and 18K to the intermediate transfer belt 28 are arranged. These primary transfer rolls 24Y, 24M 24C and 24K make up a primary transfer part 25 that performs the primary transfer from the photoreceptors 18Y, 18M, 118C and 18K to the intermediate transfer belt 18.

The primary transfer rolls 24Y, 24M, 24C and 24K each have a shaft, and a sponge layer as an elastic layer fixed around the shaft, which are not shown. The shaft is a columnar rod made of a metal such as iron and SUS. The sponge layer is a cylindrical roll formed of a blend rubber of NBR, SBR and EPDM into which a conducting agent such as carbon black is compounded.

Moreover, the primary transfer rolls 24Y, 24M, 24C and 24K are brought into pressure contact with the respective photoreceptors 18Y, 18M, 18C and 18K with the intermediate transfer belt 28 sandwiched therebetween. A voltage (primary transfer bias) having a polarity reverse to charging polarity of the respective toners (negative polarity in exemplary embodiment, the same applies to the following) is applied to the primary transfer rolls 24Y, 24M, 24C and 24K by voltage applying means (not shown).

The toner images on the respective photoreceptors 18Y, 18M, 18C and 18K are sequentially attracted electrostatically, so that the toner images superimposed on the intermediate transfer belt 28 are formed. Cleaners 26Y, 26M, 26C and 26K that remove remaining toners on the photoreceptors 18Y, 18M, 18C and 18K are provided on the downstream side in the rotation direction of the photoreceptors 18M, 18M, 18C and 18K.

Inside of the intermediate transfer belt 28, a drive roll 30 that is driven by a motor (not shown) excellent in speed constancy to move the intermediate transfer belt 28, and a supporting roll 32 that extends substantially linearly along an arrangement direction of the respective photoreceptors 18Y, 18M, 18C and 18K to support the intermediate transfer belt 28 are provided. This allows the intermediate transfer belt 28 to be driven circularly at a predetermined speed in an arrow B direction.

Moreover, inside of the intermediate transfer belt 28, a tension roll 34 that provides a constant tension to the intermediate transfer belt 28 and prevents meandering of the intermediate transfer belt 28. A secondary transfer part 42 that transfers the toner images on the intermediate transfer belt 28 onto recording paper P is provided on the downstream side in the moving direction of the intermediate transfer belt 28.

The secondary transfer part 42 is made of a secondary transfer roll 38 arranged on the side of a toner image carrying surface of the intermediate transfer belt 28 and a back-up roll 36.

The secondary transfer roll 38 is made of a shaft, and a sponge layer as an elastic layer fixed around the shaft, which are not shown. The shaft is a columnar rod made of a metal such as iron and SUS. The sponge layer is a cylindrical roll formed of a blend rubber of NBR, SBR and EPDM into which a conducting agent such as carbon black is compounded.

Moreover, the secondary transfer roll 38 is brought into pressure contact with the back-up roll 36 with the intermediate transfer belt 28 sandwiched therebetween. The secondary transfer roll 38 is earthed, and a secondary transfer bias is applied between the secondary transfer roll 38 and the back-up roll 36, so that the toner images are secondarily transferred on the recording paper P conveyed to the secondary transfer part 42.

In the back-up roll 36, a surface thereof is made of a tube of a blend rubber of EPDM and NBR with carbon dispersed, and an interior portion thereof is made of EPDM rubber. Hardness is set to 70° (ASKER C), for example. Moreover, the back-up roll 36 is arranged on the side of a back surface of the intermediate transfer belt 28, to for an opposite electrode of the secondary transfer roll 38, and the secondary transfer bias is stably applied through a metal electric supply roll 40 arranged in contact with the back-up roll 36.

On the downstream side of the secondary transfer part 42 in the moving direction of the intermediate transfer belt 28, an intermediate transfer belt cleaner 46 that removes remaining toners or paper powders on the intermediate transfer belt 28 after the secondary transfer is provided in such a manner that it can be brought into contact with, and be separated from the intermediate transfer belt 28. A cleaning back-up roll 44 is provided inside of the intermediate transfer belt 28 in the intermediate transfer belt cleaner 46.

On the upstream side of the primary transfer roll 24Y corresponding to the yellow toner and inside of the intermediate transfer belt 28, a home position sensor 48 that generates a signal as a reference for timing of image formation corresponding to the respective toners is provided. The home position sensor 48 senses a predetermined mark provided on the back side of the intermediate transfer belt 28 to generate the reference signal. Based on this reference signal, the above-described controller 70 operates the respective parts of the printer 10 to start the image formation. Moreover, on the downstream side of the primary transfer roll 24K corresponding to the black toner, an image density sensor 43 for performing image adjustment is provided.

On the other hand, on the lower side of the printer 10, a paper tray 50 that contains the recording paper P is provided. On one end of the paper tray 50, a pick-up roll 52 that takes out and conveys the recording paper P at predetermined timing is provided. Above the pick-up roll 52, a plurality of conveyance rolls 54, 56 that are driven rotationally by driving means made of a motor and a gear not shown to convey the recording paper P sent out by the pick-up roll 52 to the above-described secondary transfer part 42 are provided. On the downstream side of the conveyance rolls 56 in a conveyance direction of the recording paper P, a conveyance chute 58 that sends the recording paper P to the secondary transfer part 42 is provided.

A conveyance belt 60 that conveys the recording paper P to a fixing apparatus 100 after completing the secondary transfer of the toner images is provided in a sending-out direction of the recording paper P in the secondary transfer part 42. The conveyance belt 60 is provided so as to be tensioned by tensioning rolls 57 and 59 and be movable by drive means made of a motor or a gear not shown.

A guide 62 that guides the recording paper P to the fixing apparatus 100 is provided on the inlet side of the fixing apparatus 100. On the outlet side of the fixing apparatus 100, a paper output tray 64 fixed to the housing 12 of the printer 10 is provided.

Now, the image formation of the printer 10 is described.

Image data outputted from an image reading apparatus, a personal computer or the like not shown is subjected to predetermined image processing by an image processing apparatus not shown. In the image processing apparatus, the predetermined image processing including shading correction, displacement correction, brightness/color space conversion, gamma correction, frame deletion, and various types of image edition such as color edition and movement edition is performed for inputted reflectivity data. The image data subjected to the image processing is converted to colorant gradation data of four colors of Y, M, C and K, and is outputted to the optical scanning devices 14Y, 14M, 14C and 14K.

The optical scanning devices 14Y, 14M, 14C and 14K irradiate the optical beams 16Y, 16M, 16C and 16K to the respective photoreceptors 18Y, 18M, 18C and 18K in accordance with the inputted colorant gradation data. The surfaces of the photoreceptors 18Y, 18M, 18C and 18K are charged in advance by the chargers 20Y, 20M, 20C and 20K, and are exposed by the optical beams 16Y, 16M, 16C and 16K so as to form electrostatic latent images. The formed electrostatic latent images are developed as toner images of the respective colors of Y, M, C and K by the developing units 22Y, 22M, 22C and 22K.

Subsequently, the toner images formed on the photoreceptors 18Y, 18M, 18C and 18K are transferred onto the intermediate transfer belt 28 in the primary transfer part 25. This transfer is performed by adding the voltage (primary transfer bias) having the polarity reverse to the charging polarity of the toners (negative polarity) to the intermediate transfer belt 28 by the primary transfer rolls 24Y, 24M, 24C and 24K and sequentially superimposing the toner images on the surface of the intermediate transfer belt 28. The intermediate transfer belt 28 to which the toner images are transferred is conveyed to the secondary transfer part 42.

On the other hand, at the timing at which the toner images are conveyed to the secondary transfer part 42, the pick-up roll 52 is rotated to send out the recording paper P of a predetermined size from the paper tray 50. The recording paper P sent out by the pick-up roll 52 is conveyed by the conveyance rolls 54, 56, and reaches the secondary transfer part 42 via the conveyance chute 58. Before reaching this secondary transfer part 42, the recording paper P is once stopped to perform the alignment between the recording paper P and the toner images by rotating a resist roll (not shown) according to the movement timing of the intermediate transfer belt 28 carrying the toner images.

In the secondary transfer part 42, the secondary transfer roll 38 is pressed by the back-up roll 36 with the intermediate transfer belt 28 sandwiched therebetween. At this time, the recording paper P, which has been timed to be conveyed, is sandwiched between the intermediate transfer belt 28 and the secondary transfer roll 38. At this time, a voltage (secondary transfer bias) having the same polarity as the charging polarity (negative polarity) of the toners is applied from the electric supply roll 40, so that a transfer electric field is formed between the secondary transfer roll 38 and the back-up roll 36. The unfixed toner images carried on the intermediate transfer belt 28 is pressed by the secondary transfer roll 38 and the back-up roll 36 to be electrostatically transferred on the recording paper P collectively.

Subsequently, the recording paper P with the toner images transferred electrostatically is conveyed by the secondary transfer roll 38 in a state where the toner images are stripped off from the intermediate transfer belt 28, and is conveyed to the conveyance belt 60. In the conveyance belt 60, the recording paper P is conveyed to the fixing apparatus 100 so that the conveyance speed conforms to an optimal conveyance speed in the fixing apparatus 100. The unfixed toner images on the recording paper P conveyed to the fixing apparatus 100 are fixed on the recording paper P by the fixing apparatus 100. The recording paper P after the fixing is discharged in an arrow C direction to be accumulated in the paper output tray 64.

After the transfer to the recording paper P is completed, the remaining toners on the intermediate transfer belt 28 are conveyed to the intermediate transfer belt cleaner 46 with the rotation movement of the intermediate transfer belt 28 to be removed from the intermediated transfer belt 28. In this manner, the image formation of the printer 10 is performed.

Next, a description of the fixing apparatus 100 is given.

Figure 2:
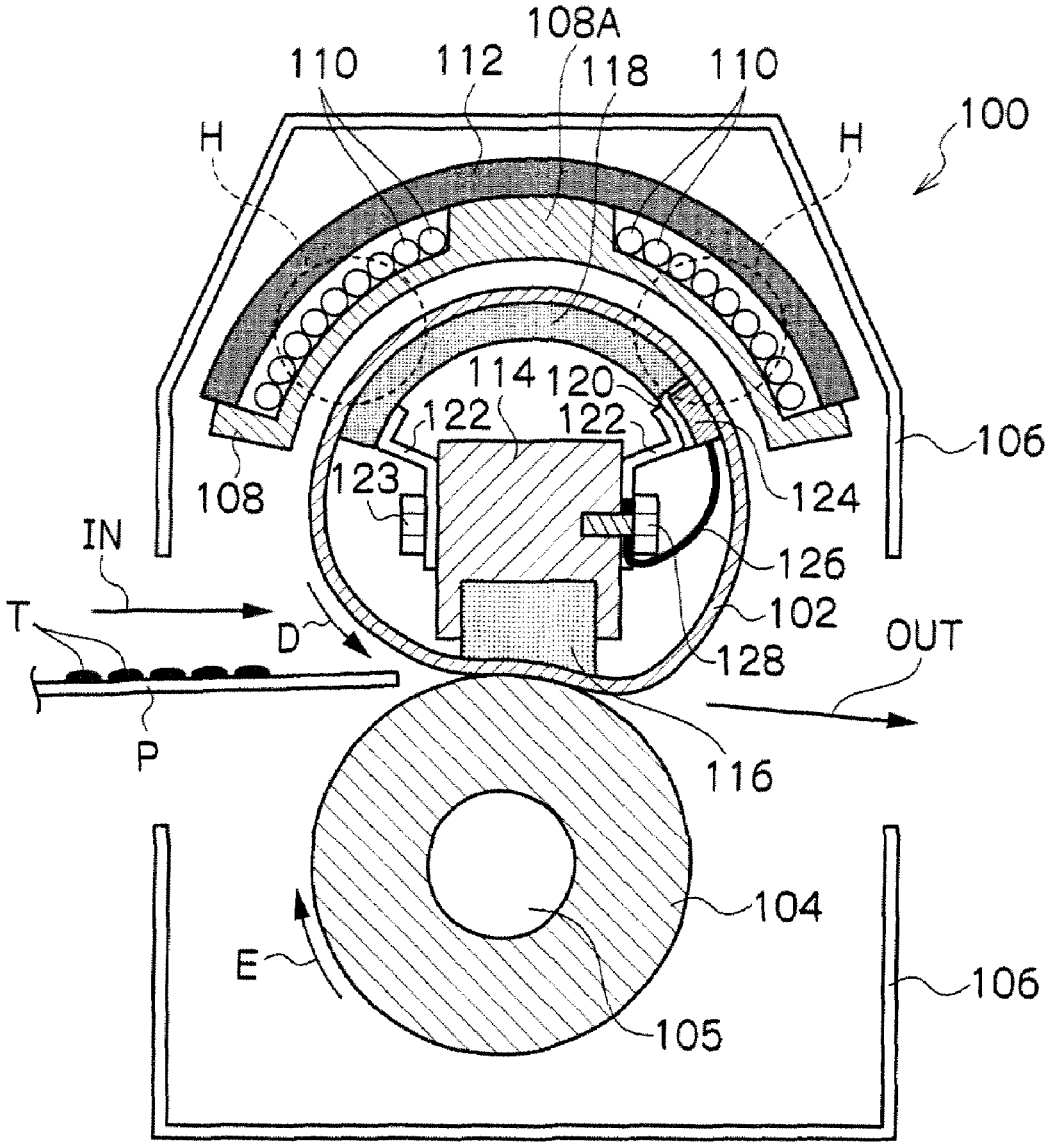
FIG. 2 is a cross-sectional diagram of a fixing apparatus according to the first exemplary embodiment of the invention.

As shown in FIG. 2, the fixing apparatus 100 includes a housing 106 in which openings for taking in and discharging the recording paper P are formed. Inside of the housing 106, an endless fixing belt 102, cap-like supporting members (illustration is omitted) are fitted in both side end portions thereof, is supported rotatably in an arrow D direction.

A bobbin 108 made of an insulating material is arranged in a position opposed to an outer circumferential surface of the fixing belt 102. The bobbin 108 is formed into a substantially circular arc following the outer circumferential surface of the fixing belt 102, and is provided with a projected portion 108A toward the opposite side of the fixing belt 102. A distance between the bobbin 108 and the fixing belt 102 is set to 1 to 3 mm.

In the bobbin 108, an exciting coil 110 that generates a magnetic field H by energization is wound in a plurality of times in an axial direction of the bobbin 108 centering on the projected portion 108A. In positions faced to the exciting coil 110 and at the opposite side of the fixing belt 102, magnetic-path forming members 112 each made of a magnetic body such as ferrite and formed into a substantially circular arc following the circular arc of the bobbin 108 are arranged and supported by the bobbin 108.

Figure 4A:
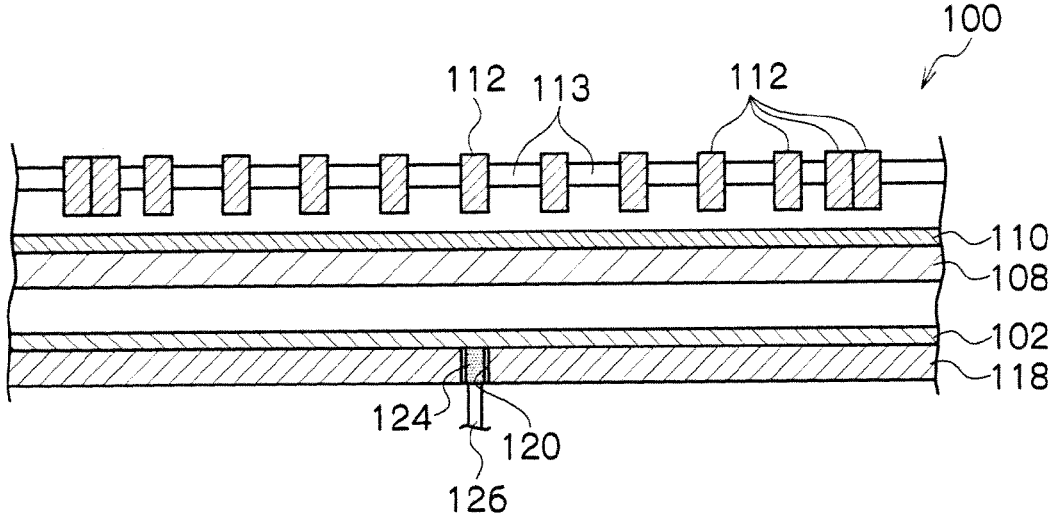
FIG. 4A is a partial cross-sectional diagram of the fixing apparatus according to the first exemplary embodiment of the present invention.

As shown in FIG. 4A, the plurality of magnetic-path forming members 112 are arranged along a width direction of the fixing belt 102, and held by a holding member 113 made of a nonmagnetic body bridged in the width direction of the fixing belt 102. The magnetic-path forming members 112 are arranged at even intervals in a central portion in a longitudinal direction of the holding member 113 while in both end portions in the longitudinal direction of holding member 113, are arranged at narrower intervals or in contact with each other. This arrangement of the magnetic-path forming members 112 allows a distribution of the magnetic field H in the width direction of the fixing belt 102 to be adjusted.

Figure 3A:
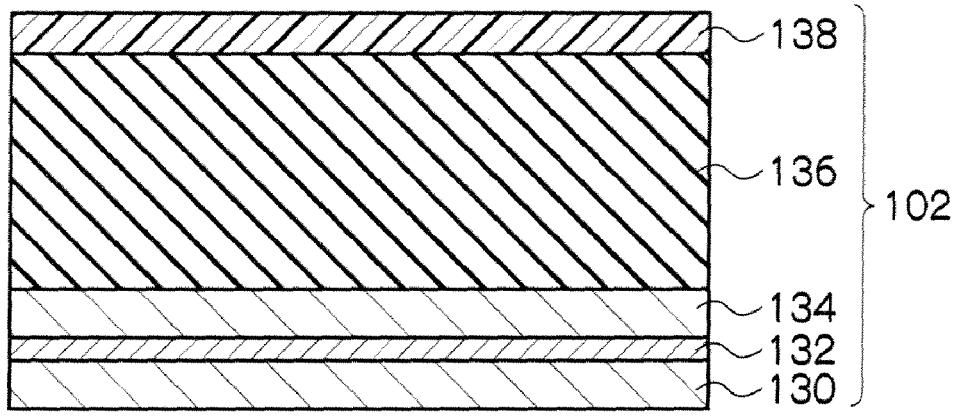
FIG. 3A is a cross-sectional diagram of a fixing belt according to the first exemplary embodiment of the invention.

As shown in FIG. 3A, the fixing belt 102 is made of a base layer 130, a heat generating layer 132, a protecting layer 134, an elastic layer 136, and a releasing layer 138, in order from the inside to the outside, and these are layered to be integrated.

The base layer 130 is a base having a strength of the fixing belt 102, for which polyimide is used with a thickness set to 50 to 200 μm. For the base layer 130, besides a resin such as polyimide, a metal such as iron, nickel, silicon, boron, niobium, copper, zirconium, and cobalt, and a soft magnetic metal material made of an alloy composed of these metals may be used.

The heat generating layer 132 is made of a metal material that generates heat by electromagnetic induction in which eddy current flows so as to generate a magnetic field which cancels out the above-described magnetic field H. Moreover, the heat generating layer 132 needs to be formed so as to be thinner than a so-called skin depth in order to pass through a magnetic flux of the magnetic field H. For the heat generating layer 132, for example, a metal of gold, silver, copper, aluminum, zinc, tin, lead, bismuth, beryllium, antimony or an alloy of these may be used. In the present exemplary embodiment, as the heat generating layer 132 copper having a thickness of 10 μm is used.

The skin depth δ (m) is represented by the following expression using a frequency f(Hz), a relative magnetic permeability μr and a specific resistance ρ (Ωm) of an exciting circuit.

$$\delta=503(\rho/(f\times\mu r))^{1/2}$$

The skin depth δ (m) represented by the above-described expression indicates a depth of absorption of an electromagnetic wave used in the electromagnetic induction, and in a point deeper than this, the intensity of the electromagnetic wave is 1/e or less. In other words, it means that most energy is absorbed until a layer reaches this depth.

For the protecting layer 134, a material that has mechanical strength higher than the heat generating layer 132, has high repeated distortion resistance, and has high rust and corrosion resistance is preferable, and in exemplary embodiment, nonmagnetic stainless steel having a thickness of 30 μm is used.

For the elastic layer 136, a silicone-based rubber or a fluorine-based rubber is used in view of excellent elasticity, heat resistance and the like. In the present exemplary embodiment, a silicone rubber having a thickness of 200 μm is used. The thickness of the elastic layer 136 is preferably 200 to 600 μm.

The releasing layer 138 is provided to easily stripe off the recording paper P from the fixing belt 102 by weakening adhesion force to a toner T (see FIG. 2) fused on the recording paper P. In order to attain excellent surface releasability, a fluoride resin, a silicone resin, or a polyimide resin is used for the releasing layer 138, and in the present exemplary embodiment, PFA (tetrafluorethylene/perfluoroalkoxyethylene copolymer resin) is used. The thickness of the releasing layer 138 is 30 μm.

As shown in FIG. 2, inside of the fixing belt 102, a prismatic support 114 made of aluminum, which is a nonmagnetic material, is arranged in a noncontact state with respect to the fixing belt 102 with a longitudinal direction of the support 114 corresponding to the width direction of the fixing belt 102. Both ends of the support 114 are fixed to the housing 106 of the fixing apparatus 100. The support 114 is formed with a depressed portion 114A along the longitudinal direction on the bottom side. A pressing pad 116 made of resin for pressing the fixing belt 102 outwards at a predetermined pressure is fixed to the depressed portion 114A. The pressing pad 116 is made of a member having elasticity, and one end surface thereof is in contact with an inner circumferential surface of the fixing belt 102 to press the fixing belt outwards.

Figure 3B:
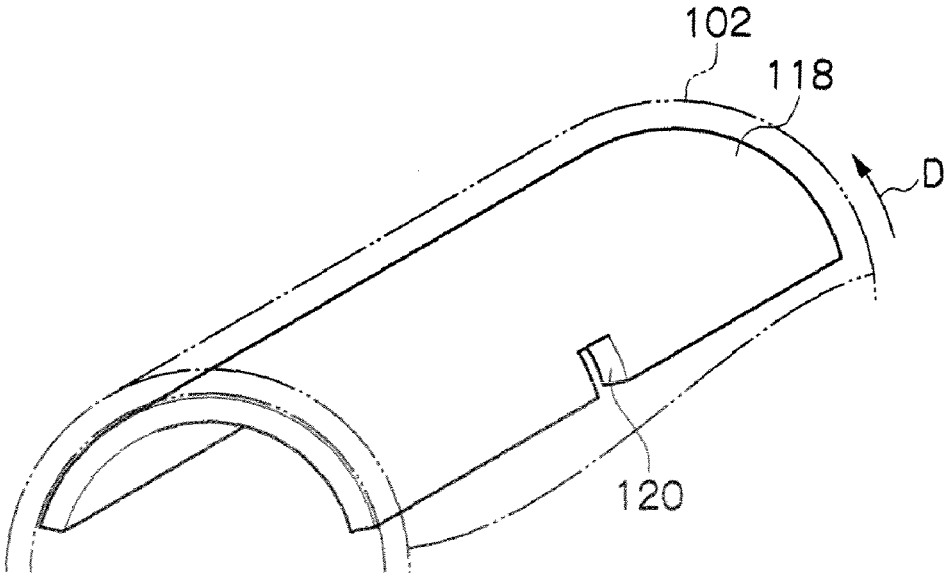
FIG. 3B is a perspective diagram of a heat generating body according to the first exemplary embodiment of the invention.

Moreover, inside of the fixing belt 102 and above the support 114, a heating member is provided so as to be opposed to the exciting coil 110, and in the present exemplary embodiment, a heat generating body 118 formed into a circular arc as shown in FIGS. 2 and 3B is used.

As shown in FIGS. 2 and 3B, the heating generating body 118 is a substantially semicylindrical member whose longitudinal direction corresponds to the width direction of the fixing belt 102, and is arranged so that a surface thereof is in contact with the inner surface of the fixing belt 102. Moreover, the heat generating body 118 is made of an iron-based alloy, and forms a closed magnetic path by the above-described magnetic field H between the magnetic-path forming members 112 and the heat generating body 118, and generates heat by the electromagnetic induction of the magnetic field H. The contact of the heat generating body 118 with the fixing belt 102 keeps temperature decrease of the fixing belt 102 smaller even if the heat of the fixing belt 102 is consumed by the recording paper P passing.

For the heat generating body 118, a magnetic metal material having a thickness more than the skin depth noted above is preferably used. The thickness more than the skin depth brings about sufficient heat generation by the action of the magnetic field, and the heat is accumulated inside of the heat generating body 118, which suppresses temperature decrease of the fixing belt 102 more. The magnetic metal material is desirably a ferromagnetic body having a relative magnetic permeability of 100 or more, more desirably a ferromagnetic body of a relative magnetic permeability of 500 or more, for example.

In the heat generating body 118, a notched portion 120 as an opening portion is formed at a central portion in the longitudinal direction and at an end portion in a circumferential direction, and at the upstream side thereof with respect to the rotation direction of the fixing belt 102. The notched portion 120 is formed in a position opposed to one of the magnetic-path forming members 112 which is provided at the central portion in the longitudinal direction of the holding member 113 (see FIG. 4A). Since the notched portion 120 is formed only by cutting the end portion of the heat generating body 118, the attachment of the temperature sensor 124 (described later) is easier as compared with a case where a through-hole is formed in the heat generating body 118.

Moreover, although it is expected that the formation of the opening portion in the heat generating body 118 will decrease a quantity of heat value of the heat generating body 118, the heating member such as the heat generating body 118 has larger heat release in a position closer to the end portion in a circumferential direction, and thus, the provision of the opening portion (notched portion) in the end portion keeps decrease of the quantity of heat value smaller in comparison with a case where the opening portion is provided at an intermediate part in a circumferential direction of the heat generating body 118. Furthermore, when the heat generating body 118 generates heat by the electromagnetic induction of the magnetic field H as in the present exemplary embodiment, the quantity of heat value becomes larger in a position closer to a central portion in a winding width of the exciting coil 110, and thus, the provision of the notched portion 120 in the end portion keeps decrease in the quantity of heat value smaller as compared with a case where a through-hole is provided at a position in the heating generating body 118 closer to the central portion in the winding width of the exciting coil 110.

A supporting member 122 is provided at a predetermined position in the longitudinal direction of the heat generating body 118 and at each end portion in the circumferential direction at the inner circumferential side of the heat generating body 118. At one-end of the supporting member 122, a substantially L-shaped supporting portion is formed and is attached at the respective inner circumferential side end of the heat generating body 118. The other end of the supporting member 122 is jointed to each side (right and left sides in FIG. 2) of the support 114 by screws 123 and 128, by which the support 114 supports the heat generating body 118.

In the notched portion 120 of the heat generating body 118, the temperature sensor 124 that makes contacts with the inner circumferential surface of the fixing belt 102 to sense a temperature of the fixing belt 102 surface is disposed. The temperature sensor 124 measures the temperature of the fixing belt 102 surface by changing resistance value in accordance with an amount of heat given from the fixing belt 102 surface.

Moreover, the temperature sensor 124 is fixed in a terminal portion of a plate spring 126 made of a resin such as polyimide, and a base end portion of the plate spring 126 is jointed to the side of the support 114 (right side in FIG. 2) by the screw 128. This allows the plate spring 126 to extend from the downstream side to the upstream side in the rotation direction of the fixing belt 102 along the inner circumferential surface of the fixing belt 102, and the temperature sensor 124 is located in the notched portion 120 along the inner circumferential surface of the fixing belt 102.

Figure 4B:
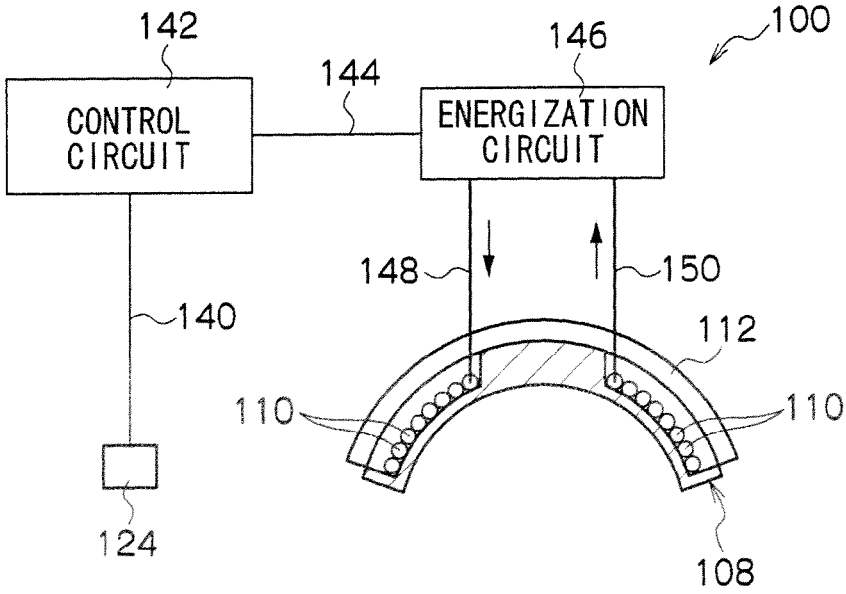
FIG. 4B is a connection diagram of a control circuit and an energization circuit according to the first exemplary embodiment of the invention.

As shown in FIG. 4B, the temperature sensor 124 is connected to a control circuit 142 provided inside of the above-described controller 70 (see FIG. 1) through wiring 140.

Moreover, the control circuit 142 is connected to an energization circuit 146 through wiring 144, and the energization circuit 146 is connected to the above-described exciting coil 110 through wiring 148 and 150.

The control circuit 142 measures a temperature on the inner circumferential side of the fixing belt 102 based on an amount of electricity sent from the temperature sensor 124, and converts it to a temperature on the outer circumferential side of the fixing belt 102, and then, compares this converted temperature with a fixing setting temperature stored in advance (170° C. in the present exemplary embodiment). When the converted temperature is lower than the fixing setting temperature, the energization circuit 146 is driven to energize the exciting coil 110, and generate the magnetic field H as a magnetic circuit (see FIG. 2). When the converted temperature is higher than the fixing setting temperature, the energization circuit 146 is stopped.

The energization circuit 146 is driven or the driving thereof is stopped based on the electric signal sent from the control circuit 142, and an alternating current of a predetermined frequency is supplied to the exciting coil 110 through the wiring 148, 150, or the supply thereof is stopped.

As shown in FIG. 2, a pressurizing roll 104 that pressurizes the fixing belt 102 toward the pressing pad 116, and is rotated in an arrow E direction by a driving mechanism made of a motor and a gear not shown is arranged in a position opposed to the outer circumferential surface of the fixing belt 102.

The pressurizing roll 104 is constituted so that a silicone rubber and PFA are covered around a cored bar 105 made of a metal such as aluminum. The pressurizing roll 104 pressurizes the fixing belt 102 to the pressing pad 116 side, so that the fixing belt 102 is in a state depressed inwards at a contact portion (nip portion) formed between the fixing belt 102 and the pressurizing roll 104.

A shape of this nip portion is curved in a direction where the recording paper P with the toner T placed thereon is stripped off from the fixing belt 102 when it passes this nip portion. Thereby, the recording paper P conveyed from an arrow IN direction is discharged in an arrow OUT direction while following the shape of the nip portion because of stiffness of the paper itself.

Next, operations of the first exemplary embodiment of the present invention are described. First, a fixing operation of the fixing apparatus 100 is described.

As shown in FIGS. 1 to 4B, the recording paper P (or envelope) to which the toner T is transferred via the image forming process of the above-described printer 10 is sent to the fixing apparatus 100. In the fixing apparatus 100, a drive motor not shown is driven by the controller 70, so that the pressurizing roll 104 is rotated in an arrow E direction, and following this, the fixing belt 102 is rotated in the arrow D direction. At this time, the energization circuit 146 is driven based on an electric signal from the control circuit 142, and an alternating current is supplied to the exciting coil 110.

When the alternating current is supplied to the exciting coil 110, the magnetic field H as a magnetic circuit is repeatedly generated and extinguished in the vicinity of the exciting coil 110. When the magnetic field H crosses the heat generating layer 132 of the fixing belt 102, an eddy current is generated in the heat generating layer 132 so as to generate a magnetic field preventing change of the magnetic field H. The heat generating layer 132 generates heat in proportion to the magnitudes of the skin resistance of the heat generating layer 132 and the eddy current flowing the heat generating layer 132, resulting in the heating of the fixing belt 102.

Similarly, the heat generating body 118 generates heat by the electromagnetic induction action of the magnetic field H to heat the fixing belt 102. Thus, since the heat generating layer 132 and the heat generating body 118 are heated by the same exciting coil 110, power consumption is lower as compared with a case where the heat generating layer 132 and the heat generating body 118 are heated by different heat sources.

The temperature of the fixing belt 102 surface is sensed by the temperature sensor 124 and when it does not reach the fixing setting temperature, the control circuit 142 controls the driving of the energization circuit 146 to apply an alternating current of a predetermined frequency to the exciting coil 110. Moreover, when the temperature of the fixing belt 102 surface reaches the fixing setting temperature, the control circuit 142 stops the control of the energization circuit 146.

The temperature sensor 124 is fixed to the terminal portion of the plate spring 126, and the base portion of the plate spring 126 is jointed to the support 114. Thereby, the plate spring 126 is extended out from the downstream side to the upstream side in the rotation direction of the fixing belt 102 along the inner circumferential surface of the fixing belt 102. The temperature sensor 124 is arranged in the end portion of the heat generating body 118 at the upstream side in the rotation direction of the fixing belt 102 along the inner circumferential surface of the fixing belt 102. Therefore, even if the temperature sensor 124 is pulled by the rotation of the fixing belt 102, external force acts to the temperature sensor 124 in a direction where the temperature sensor 124 is contained in the notched portion 120. This allows the temperature sensing position by the temperature sensor 124 to fall into the heating region opposed to the exciting coil 110.

Subsequently, the recording paper P sent by the fixing apparatus 100 is heated and pressed by the fixing belt 102 and the pressurizing roll 104 at the predetermined fixing setting temperature so that the toner images are fixed on the recording paper P surface, and the fixed recording paper P is discharged into the paper output tray 64.

Next, a temperature in the circumferential direction of the fixing belt 102 is described.

Figure 5A:
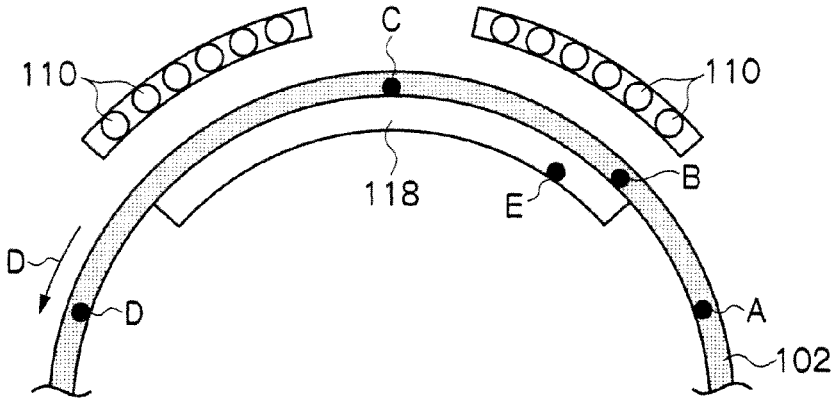
FIG. 5A is a schematic diagram showing temperature sensing positions of the fixing belt and the heat generating body according to the first exemplary embodiment of the invention.

FIG. 5A is a schematic diagram showing positions A to E that are sensing positions of the temperature of the fixing belt 102 in the circumferential direction and a sensing position of the temperature of the heat generating body 118. The temperatures of the respective portions excluding B are sensed using temperature sensors not shown.

The position A is a sensing position at the inner circumferential surface of the fixing belt 102. The position A is located at the upstream side of a region opposed to the exciting coil 110 in the circumferential direction of the fixing belt 102. The position B is a sensing position where the temperature sensor 124 (see FIG. 2) senses and located in a region opposed to the exciting coil 110 and the heat generating body 118. The position B is located at the inner circumferential surface of the fixing belt 102.

The position C is a sensing position corresponding to the projected portion 108A of the bobbin 108 (see FIG. 2), and located in a region not opposed to the exciting coil 110 at the inner circumferential surface of the fixing belt 102. The position D is a sensing position symmetric to the position A centering on the position C, and located in the region not opposed to the exciting coil 110 at the inner circumferential surface of the fixing belt 102.

The position E is a sensing position adjacent to the position B at an inner circumferential surface (opposite side of the fixing belt 102) of the heat generating body 118. The position E is set for comparing the temperatures at the inner circumferential surface of the heat generating body 118 and at the inner circumferential surface of the fixing belt 102.

Figure 5B:
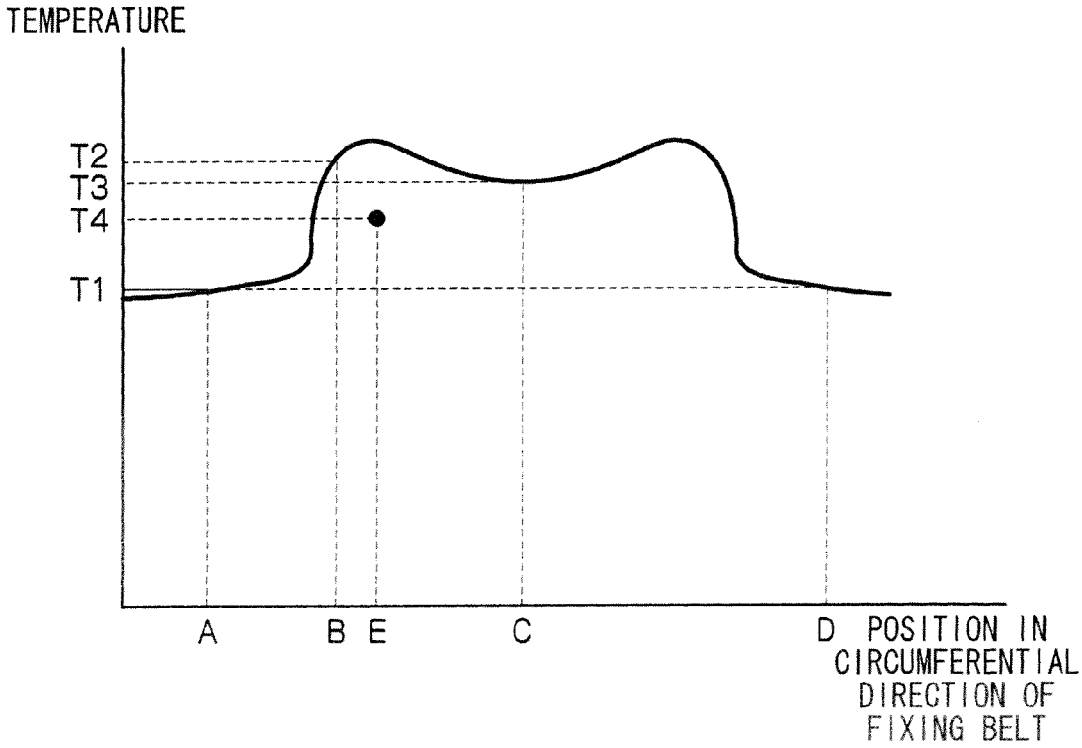
FIG. 5B is a graph showing a relation between the temperature sensing positions and the temperature of the fixing belt and the heat generating body according to the first exemplary embodiment of the invention.

For example, a relation between the positions in the circumferential direction of the fixing belt 102 and the sensed temperature when the fixing belt 102 is heated in a state where the rotation is stopped is shown in FIG. 5B.

In FIG. 5B, in the position A, the sensed temperature of the fixing belt 102 is T1. In the position B, since the heat generating layer 132 (see FIG. 3A) of the fixing belt 102 and the heat generating body 118 generate heat by the electromagnetic induction action of the magnetic field H created by the exciting coil 110, the sensed temperature of the fixing belt 102 is T2, which is higher than T1.

In the position C, while the heat generating body 118 releases heat by heat conduction from a region heated by the magnetic field H to heat the fixing belt 102, the exciting coil 110 does not exit thus, a heating amount is smaller and the sensed temperature of the fixing belt 102 is T3 lower than T2. At the point D, since it is out of the region heated by the magnetic field H, the sensed temperature of the fixing belt 102 is the temperature T1 equivalent to that of the position A.

At the point E, since heat capacity of the fixing belt 102 is smaller than heat capacity of the heat generating body 118, temperature rising of the fixing belt 102 is faster. Therefore, the sensed temperature of the heat generating body 118 is T4 lower than the sensed temperature T2 at the point B of the fixing belt 102.

Normally, since during fixing, the fixing belt 102 is rotated, the temperature of the heat generating body 118 is higher. However, when heating is performed in the state where the rotation of the fixing belt 102 is stopped as described above, a temperature rising rate of the fixing belt 102, which has smaller heat capacity, is faster than that of the heat generating body 118, and as a result, the temperature on the fixing belt 102 side becomes higher.

Since the magnetic-path forming members 112 collect the magnetic fields of the magnetic field H to form the closed magnetic path, the temperature on the inner circumferential surface of the fixing belt 102 in the heated region opposed to the exciting coil 110 becomes the highest, and the temperature in this region is sensed by the temperature sensor 124 (see FIG. 2) to control the temperature by the control circuit 142 (see FIG. 4B). This will suppress excessive temperature rising of the fixing belt 102.

Figure 6A:
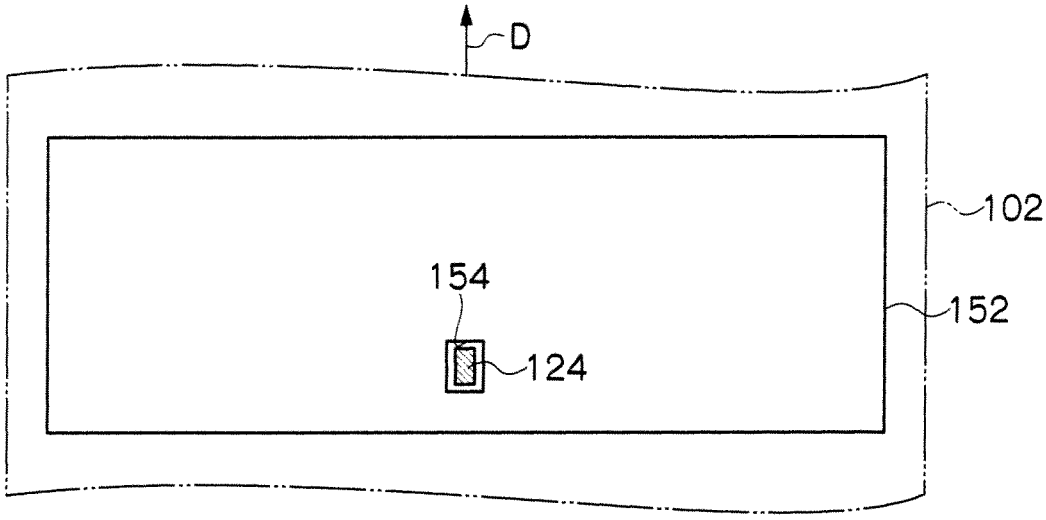
FIGS. 6A and 6B are plane diagrams each showing another example of the heat generating body according to the first exemplary embodiment of the invention.
Figure 6B:
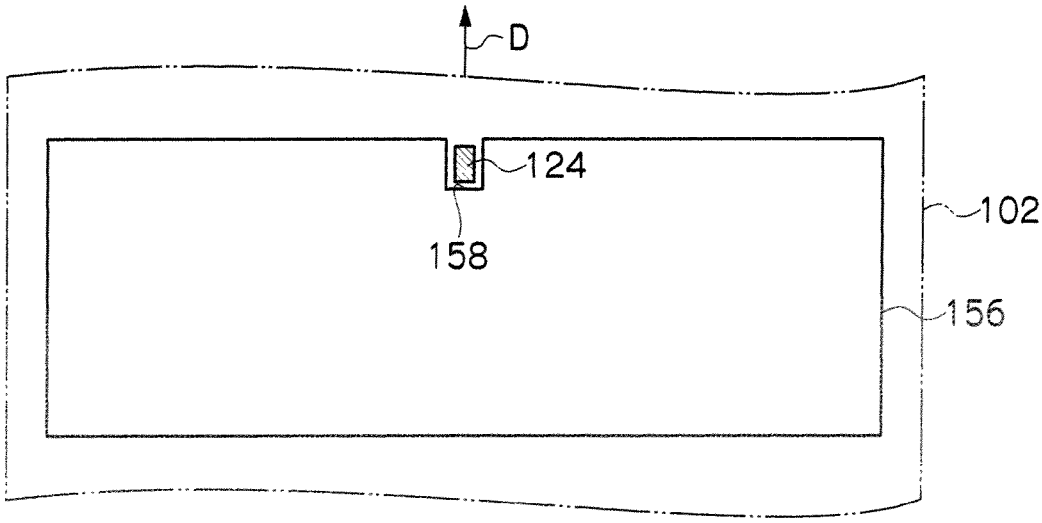

As another example of the heating generating body 118 of the fixing apparatus 100, for example, heat generating bodies 152 and 156 shown in FIGS. 6A and 6B may be used. In the heat generating body 152, a through-hole 154 is formed closer to the central portion in the circumferential direction of the heat generating body 152 and at the upstream side in the rotation direction of the fixing belt 102 than the notched portion 120 of the above-described heat generating body 118. Moreover, in the heat generating body 156, a notched portion 158 is formed in an end portion at the opposite side of the notched portion 120 (at the downstream side in the rotation direction of the fixing belt 102). When the heating generating body 156 is used, the temperature sensor 124 is caused to be adhered, or a frame or the like for fixing is provided.

Next, a second exemplary embodiment of the fixing apparatus and the image forming apparatus of the invention is described based on the drawings. Basically the same parts as those in the above-described first exemplary embodiment are given the same numerals and signs as those of the first exemplary embodiment, and their descriptions are omitted.

Figure 7:
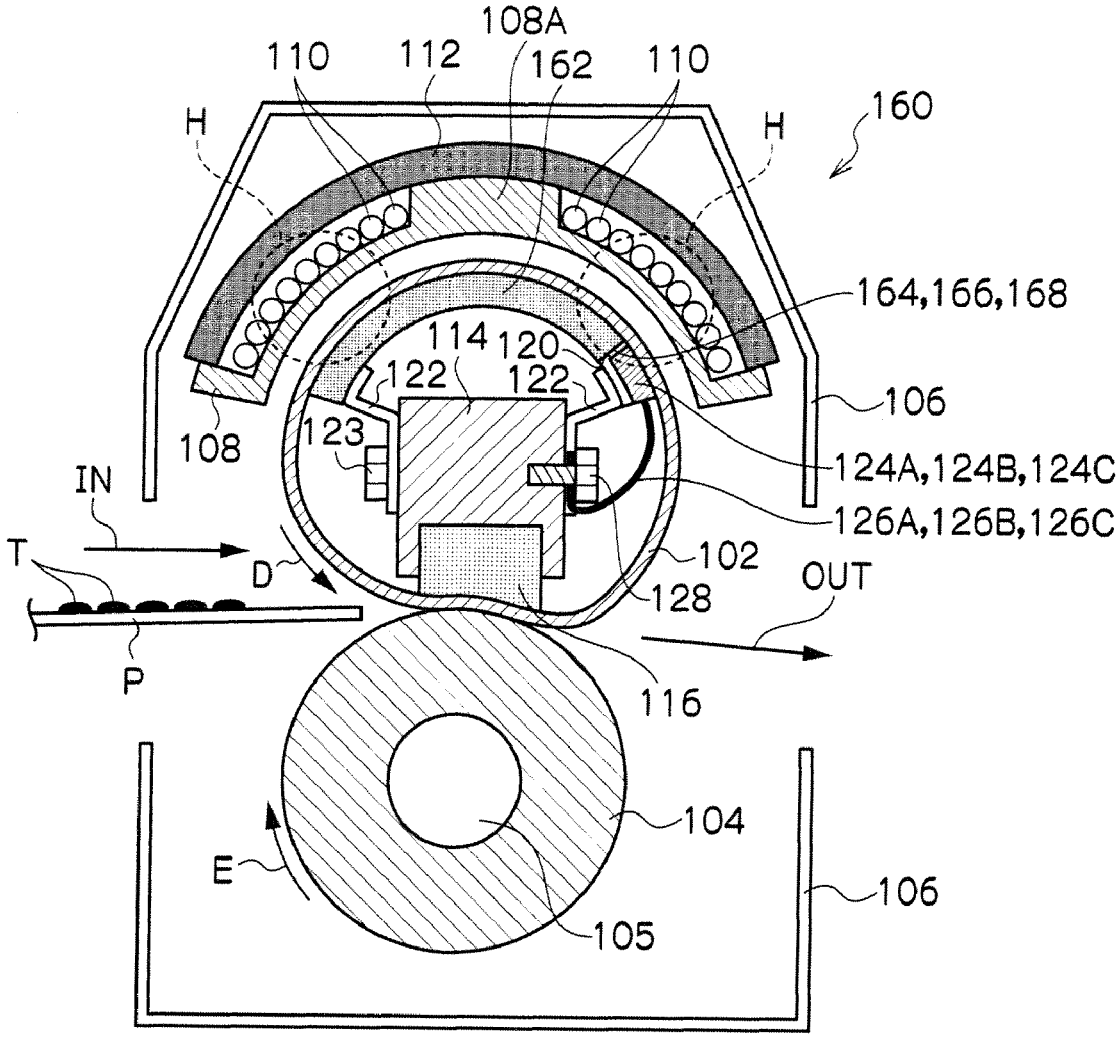
FIG. 7 is a cross-sectional diagram of a fixing apparatus according to a second exemplary embodiment of the present invention.

A fixing apparatus 160 is shown in FIG. 7. The fixing apparatus 160 has a constitution using a heat generating body 162 in place of the heat generating body 118 of the fixing apparatus 100 of the first exemplary embodiment.

Figure 8A:
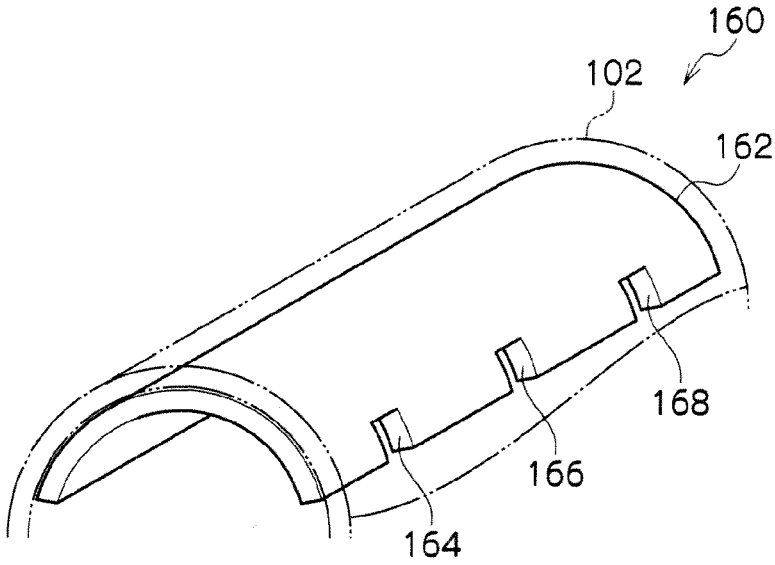
FIG. 8A is a perspective diagram of a heat generating body according to the second exemplary embodiment of the invention.
Figure 8B:
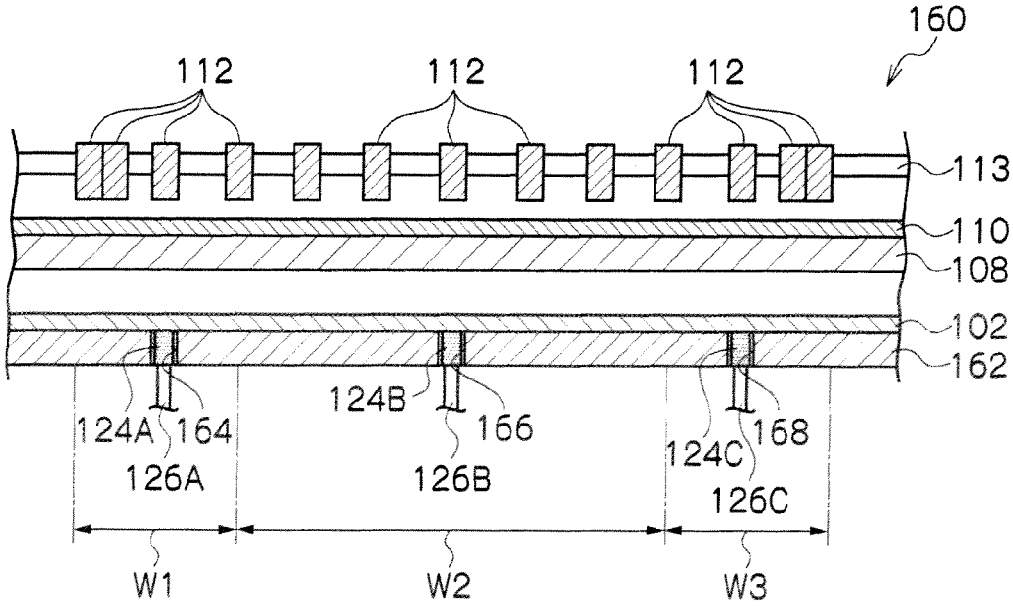
FIG. 8B is a partial cross-sectional diagram of the fixing apparatus according to the second exemplary embodiment of the invention.

As shown in FIGS. 7, 8A and 8B, the heat generating body 162 is a substantially semicylindrical member whose longitudinal direction corresponds to the width direction of the fixing belt 102, and is arranged so that a surface thereof is in contact with the inner surface of the fixing belt 102. Moreover, the heat generating body 162 is made of an iron-based alloy and forms a closed magnetic path by the above-described magnetic field H between the magnetic-path forming members 112 and the heat generating body 162, and at the same time, generates heat by the electromagnetic induction action of the magnetic field H1.

In the heat generating body 162, a plurality of notched portions 164, 166 and 168 are formed in an end portion in a circumferential direction and at the upstream side in the rotation direction of the fixing belt 102. The notched portion 166 is located substantially in the center in the longitudinal direction of the heat generating body 162, and is within a region of a width W2 when recording paper of a small size passes on the fixing belt 102. Moreover, the notched portions 164 and 168 are located in both end portions of the heat generating body 162 in the longitudinal direction, which are outside of the region of the width W2, and inside of a region of a width W1+W2+W3 when recording paper of a large size passes on the fixing belt 102.

In the respective notched portions 164, 166 and 168, the above-described temperature sensors 124 (124A, 124B and 124C) are disposed, respectively, and the respective temperature sensors 124 are fixed to the support 114 through the plate springs 126 (126A, 126B and 126C). Moreover, the respective sensors 124A, 124B and 124C are arranged so as to be opposed to the magnetic-path forming members 112.

Next, operations of the second exemplary embodiment of the invention are described.

As shown in FIGS. 7 and 8, in the fixing apparatus 160, when fixing of the toners is continuously performed to the recording paper P of the small size, in the region of the width W2 of the fixing belt 102, an amount of heat is deprived by the recording paper P, so that the temperature of the fixing belt 102 becomes lower than the fixing setting temperature.

Figure 9:
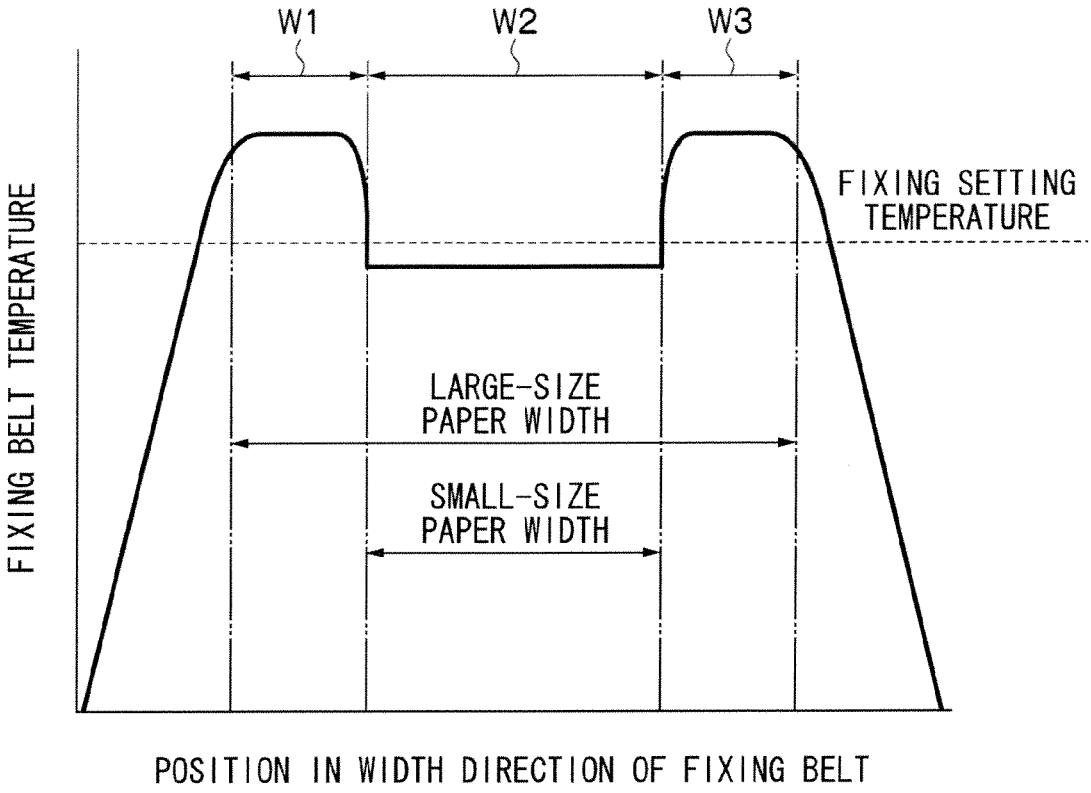
FIG. 9 is a graph showing a relation between positions in a width direction of the fixing belt and a fixing belt temperature according to the second exemplary embodiment of the invention.

At this time, since the temperature sensed by the temperature sensor 124B becomes the lowest within the temperature sensors 124A to 124C, the control circuit 142 (see FIG. 4B) controls the energization circuit 146 (see FIG. 4B) so as to bring the temperature of the fixing belt 102 closer to the fixing setting temperature, based on a difference between the sensed temperature by the temperature sensor 124B and the fixing setting temperature, and the heat generating body 162 generates heat. Although this raises a temperature of the entire fixing belt 102, in the regions of the widths W1 and W3 (non-paper-conveyance region) in the fixing belt 102, the heat is not deprived by the recording paper P, and thus, an amount of heat is accumulated, which makes the temperature higher than that in the region of the width W2. As a result, as shown in FIG. 9, a graph exhibits a high temperature on the both end portion sides.

Since the temperature sensors 124A and 124C are located outside of the passage region (W2) of the recording paper P of the small size, and inside of the passage region (W1 W3) of the recording paper P of the large size, a temperature of a highest temperature portion of the fixing belt 102 is sensed.

On the other hand, when the recording paper P of the large size is fixed, even if there is partially a position at a high temperature, any of the temperature sensors 124A to 124C senses the temperature of the high-temperature portion because the plurality of temperature sensors 124A, 124B and 124C are arranged in the longitudinal direction of the heat generating body 162.

Figure 10:
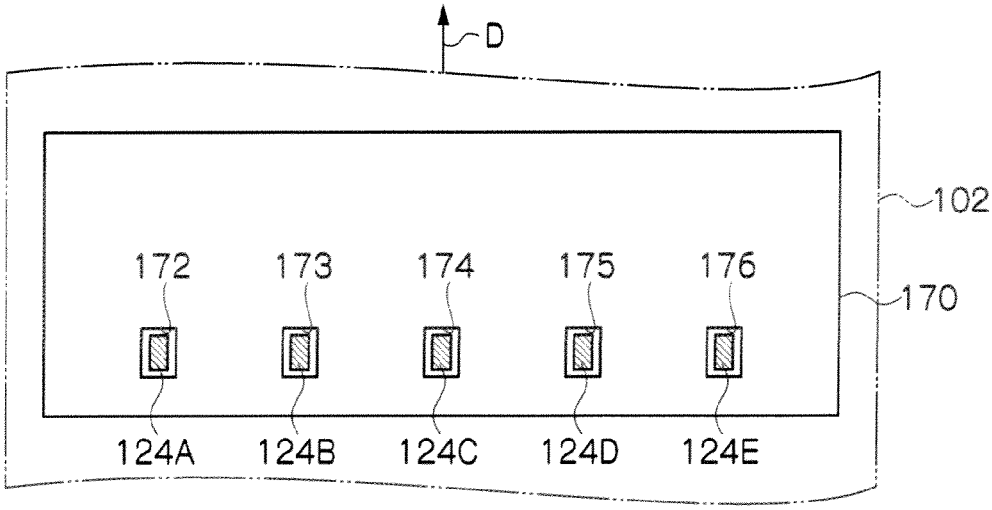
FIG. 10 is a plane diagram showing another example of the heat generating body according to the second exemplary embodiment of the invention.

As another example of the heat generating body 162, for example, a heat generating body 170 shown in FIG. 10 may be used. In the heat generating body 170, through-holes 172, 173, 174, 175 and 176 are formed in positions closer to the central portion in the circumferential direction than the notched portions 164, 166 and 168 of the heat generating body 162, and on the upstream side in the rotation direction of the fixing belt 102. In the through-holes 172 to 176, the temperature sensors 124 (124A to 124E) are provided, respectively. In this manner, by arranging the plurality of temperature sensors 124 in the longitudinal direction of the fixing belt 102, a temperature in a highest temperature portion of the fixing belt 102 in the longitudinal direction is sensed.

The present invention is not limited to the above-described exemplary embodiments.

The printer 10 may be not only of a dry electrophotographic system using a solid developer, but of a type using a liquid developer. Moreover, the heat generating bodies 118 and 162 may be sheet heat generating bodies that generate heat by supplying electricity. Furthermore, as sensing means of the temperature of the fixing belt 102, a thermocouple may be used in place of the temperature sensor 124.

A shape of the notched portion 120 may be not only rectangular but circular arc or multangular. Moreover, in place of the notched portion 120, a depressed portion as an opening portion may be formed in an outer circumferential surface of each of the heat generating bodies 118 and 162, where the temperature sensor 124 may be arranged. When the magnetic field H is the most intensive in a central portion in a width direction of the exciting coil 110 in a bundle, the notched portion 120 may be advantageously formed in a position opposed to the central portion of the exciting coil 110 to arrange the temperature sensor 124.

What is claimed is:

1. A fixing apparatus comprising:

a magnetic-field generating part that generates a magnetic field;

a fixing rotating body having a heat generating layer that generates heat by an electromagnetic induction action of the magnetic field;

a pressurizing member that applies pressure to an outer circumferential surface of the fixing rotating body;

a heating member that is arranged in contact with an inner side of the fixing rotating body so as to be opposed to the magnetic-field generating part, and heats the fixing rotating body; and a temperature sensing part that is located within a region where the fixing rotating body is opposed to the magnetic-field generating part and where the fixing rotating body is in contact with the heating member, and senses a temperature of the fixing rotating body.

2. The fixing apparatus of claim 1, wherein the temperature sensing part is arranged in an opening portion formed in the heating member.

3. The fixing apparatus of claim 2 wherein the opening portion is a notch formed in an end portion in a circumferential direction of the heating member, the circumferential direction thereof corresponding to a circumferential direction of the fixing rotating body.

4. The fixing apparatus of claim 2, wherein a plurality of the opening portions are formed in a longitudinal direction, which is substantially perpendicular to the circumferential direction of the heating member.

5. The fixing apparatus of claim 4, wherein at least one of the plurality of opening portions is formed outside of a region corresponding to a width of a minimum-size recording medium that can be passed on the fixing rotating body, and inside of a region corresponding to a width of a maximum-size recording medium that can be passed on the fixing rotating body.

6. The fixing apparatus of claim 2, wherein the opening portion is provided at the end portion in the circumferential direction of the heating member, the end portion thereof is located at the upstream side in a rotation direction of the fixing rotating body, and a supporting part of the temperature sensing part is provided at the upstream side of the opening portion in the rotation direction of the fixing rotating body.

7. The fixing apparatus of claim 1, wherein the heating member is a heat generating body that generates heat by an electromagnetic induction action of the magnetic field.

8. The fixing apparatus of claim 2, wherein a magnetic body is provided on an opposite side at the magnetic-field generating part with respect to the fixing rotating body, and the opening portion is formed in a region that is opposed to the magnetic body at the heating member.

9. An image forming apparatus comprising:

the fixing apparatus of claims 1, an exposure unit that exposes an image carrying body;

a development unit that actualizes, by a developer, a latent image formed on the image carrying body by the exposure, and forms a developed image;

a transfer member that transfers the developed image actualized by the development unit to a recording medium; and a conveyance part that conveys, to the fixing apparatus, the recording medium with the developed image transferred by the transfer member.

10. The image forming apparatus of claim 9, wherein, in the fixing apparatus, the temperature sensing part is arranged in an opening portion formed in the heating member.

11. The fixing apparatus of claim 10, wherein the opening portion is a notch formed in an end portion in a circumferential direction of the heating member, the circumferential direction thereof corresponding to a circumferential direction of the fixing rotating body.

12. The fixing apparatus of claim 10, wherein a plurality of the opening portions are formed in a longitudinal direction, which is substantially perpendicular to the circumferential direction of the heating member.

13. The fixing apparatus of claim 12 wherein at least one of the plurality of opening portions is formed outside of a region corresponding to a width of a minimum-size recording medium that can be passed on the fixing rotating body, and inside of a region corresponding to a width of a maximum-size recording medium that can be passed on the fixing rotating body.

14. The fixing apparatus of claim 10, wherein the opening portion is provided at the end portion in the circumferential direction of the heating member, the end portion thereof is located at the upstream side in a rotation direction of the fixing rotating body, and a supporting part of the temperature sensing part is provided at the upstream side of the opening portion in the rotation direction of the fixing rotating body.

15. The fixing apparatus of claim 9, wherein, in the fixing apparatus, the heating member is a heat generating body that generates heat by an electromagnetic induction action of the magnetic field.

16. The fixing apparatus of claim 10, wherein a magnetic body is provided on an opposite side at the magnetic-field generating part with respect to the fixing rotating body, and the opening portion is formed in a region that is opposed to the magnetic body at the heating member.

* * * * *